United States Patent [19]

Campbell

[11] 3,958,376

[45] May 25, 1976

[54] EXTENDIBLE TOWER STRUCTURE

[75] Inventor: Preston M. Campbell, Fort Mill, S.C.

[73] Assignee: Zip Up, Inc., Rock Hill, S.C.

[22] Filed: Feb. 15, 1974

[21] Appl. No.: 442,845

[52] U.S. Cl. ..... 52/115; 92/53; 182/63; 254/93 VA

[51] Int. Cl.[2] ..... B66F 11/04

[58] Field of Search ..... 182/141, 148, 63; 52/28, 114, 115, 117, 118, 121, 111; 212/55; 92/51–53; 254/93 L, 93 VA

[56] References Cited

UNITED STATES PATENTS

| | | | |
|---|---|---|---|
| 990,570 | 4/1911 | Lavery | 52/115 |
| 2,081,248 | 5/1937 | Murphy | 92/51 |
| 2,595,307 | 5/1952 | Selberg | 52/115 |
| 2,887,191 | 5/1959 | Lovell | 52/115 |
| 3,095,945 | 7/1963 | Mitchell | 182/148 X |
| 3,099,332 | 7/1963 | Marco et al. | 182/63 X |
| 3,353,686 | 11/1967 | Cowan | 212/55 |
| 3,398,492 | 8/1968 | Nansel | 212/55 |
| 3,419,157 | 12/1968 | Brady | 212/55 |
| 3,809,249 | 5/1974 | Grove | 212/55 |
| 3,817,007 | 6/1974 | Hall | 52/118 X |

FOREIGN PATENTS OR APPLICATIONS

| | | | |
|---|---|---|---|
| 180,486 | 6/1936 | Switzerland | 95/53 |
| 4,375 | 9/1882 | United Kingdom | 95/53 |
| 1,158,982 | 6/1958 | France | 52/115 |
| 1,268,804 | 5/1968 | Germany | 212/55 |
| 2,018,820 | 11/1970 | Germany | 212/55 |
| 466,824 | 3/1914 | France | 52/115 |
| 268,875 | 10/1912 | Germany | 52/115 |
| 295,440 | 11/1916 | Germany | 52/111 |

*Primary Examiner*—Ernest R. Purser
*Assistant Examiner*—Leslie Braun
*Attorney, Agent, or Firm*—Wellington M. Manning, Jr.

[57] ABSTRACT

An extendible tower is disclosed and includes a plurality of nestable tower sections that may be raised from a telescoping, nested position to an extended position and support a load thereat. A plurality of inverted hydraulic cylinders are located within the tower sections and are also nestable in a collapsed position. Upon receipt of hydraulic pressure, the cylinders move upwardly and extend the nested tower sections. In this regard, the hydraulic cylinder group is secured at opposite ends to a base and to the upper tower section with no securement intermediate along the length thereof. Each hydraulic cylinder and each tower section is provided with means to couple the particular section or cylinder to the next adjacent section or cylinder so as to permit continued raising thereof.

7 Claims, 3 Drawing Figures

EXTENDIBLE TOWER STRUCTURE

BACKGROUND OF THE INVENTION

Extendible towers have been well known in the art for substantial periods of time. The present invention relates to a collapsible tower that may be portable or may be permanently secured on location. Portability of such a tower is feasible only if the tower is capable of assuming a collapsed state during transportation. Likewise, for both the portable tower and the stationary tower, collapsibility of the tower greatly enhances the advantages of the tower due to ease of performing preventive maintenance and repair to the tower as well as replacement of items such as light bulbs used with apparatus secured to the top of the tower. Extendible or collapsible towers are presently existent and generally are mounted on a trailer, truck, platform or the like. Further, present extendible towers are generally employed to support banks of lights for illuminating construction sites, carnivals, fairgrounds and the like; to support signs for advertising; to support platforms that provide a work surface, and the like.

Heretofore, extendible towers have generally been constructed from welded sections and raised and lowered by various arrangements of a plurality of cables or the like. These towers are cumbersome, very expensive and represent definite safety hazards. The sections, for example, have generally been fabricated from a plurality of structural members welded together to form a skeletal structure. Skeletal structures when extended, offer less resistance to the wind than a solid structure of the same size, but are much more expensive to fabricate. Prior towers further have assumed various geometrical shapes such as triangles, circles, rectangles, etc. and, for the most part, the geometric shapes have provided edges around which guides were employed to maintain alignment between the sections. Raising and lowering of the prior art towers has normally been accomplished by a plurality of cables either interconnected between the sections as a continuous cable or as separate cables connecting each section to the next adjacent section.

Most of the presently existing towers have been found to be deficient in certain aspects. For example, structures used in the prior towers have dictated excessive expense in fabrication of the sections; set up and maintenance of the cable system; in the size and strength of the platform, trailer or the like required for transporting the tower, etc. Hence, economics precludes feasible use of existing towers for numerous situations. Further, presently existing towers may present safety hazards during raising, lowering and while standing in the raised position. Continued application of force to the cable system after the tower has been completely raised can cause the tower to buckle and fall. Likewise, during raising and lowering, certain of the presently existing towers are dangerous.

The tower of the present invention overcomes certain of the problems and disadvantages of the prior towers. Specifically, the instant tower is economical to manufacture, has a low maintenance profile, is safe, efficient and easy to operate and transport and in general is a very reliable structure.

SUMMARY OF THE INVENTION

It is an object of the present invention to provide an improved extendible tower.

Another object of the present invention is to provide an extendible tower utilizing a hydraulic system for raising and collapsing the tower.

Still further, another object of the present invention is to provide an extendible tower comprising nestable sections, each of which is provided with coupling means so as to unite the individual sections during raising of the tower and disassociate the sections during lowering of the tower.

Yet another object of the present invention is to provide an extendible tower that employs inverted hydraulic cylinders to raise the tower sections to an extended position.

Generally speaking, the present invention relates to an extendible tower comprising a base, a first tower section secured to said base and a plurality of extendible, nestable tower sections received within said first tower section, each extendible tower section having means provided thereon to couple the next adjacent extendible section thereto, whereby each extendible section pulls the next adjacent section to its raised position; a plurality of nestable hydraulic cylinders received within said tower sections, the largest of said cylinders being secured at an upper end thereof to the first raiseable tower section and a smallest of said cylinders being secured to said base, each raiseable cylinder engaging the next adjacent smaller cylinder and raising same; and a source of hydraulic fluid under pressure in communication with said cylinders for raising and lowering said tower.

More specifically, the tower of the present invention is produced from a plurality of nestable sections that are preferably extruded or of fabricated metal with each section being smaller in size than the next adjacent section and being received within said section, whereby in the collapsed condition, all of the sections reside within a single largest section that is secured to a tower support structure. The tower of the present invention is raised and lowered by a hydraulic system which comprises a plurality of hydraulic cylinders that are nestable in similar fashion to the nestable tower sections, except that each of the hydraulic cylinders resides over a next smaller cylinder. The smallest hydraulic cylinder is thus positioned on the bottom and secured to the base while the largest hydraulic cylinder is secured to the top tower section and is first raised to act upon the top tower section and raise same. In this fashion, as each hydraulic cylinder moves upwardly to an extended position, a comparable tower section likewise moves upwardly, though not directly connected to the mating cylinder.

Inversion of the hydraulic cylinders so as to provide the largest cylinder as the first to be raised, affords definite advantage to the tower of the present invention. In this regard, it is a normal circumstance with hydraulic cylinders that the exterior of the cylinders is a contact surface and thus must be properly maintained, such as by chrome plating or the like to continually insure a proper liquid seal around the upper end thereof. Extreme care must thus be taken with respect to the aforementioned system to preclude the possibility of damage or failure which could result in collapse of the tower. Insofar as the present system is concerned, since the hydraulic system is inverted and the large cylinder resides on the top, only the inside surfaces of the cylinders are contact surfaces. Outer surfaces of the cylinders thus do not require an inordinate amount of service or care, and chrome plating or some other expensive treatment is not required. Instead, little or no care is required of the outer surfaces of the cylinders more than enclosing same within the tower sections.

Once hydraulic fluid is pumped into the larger cylinder, the fluid pressure causes the larger cylinder to move upwardly and thus likewise carries the upper tower section upwardly since the cylinder is secured thereto. As the hydraulic cylinder moves upwardly, a collar or other means secured around a lower end thereof engages a shoulder or some portion of a piston that is provided at the junction between the first and second hydraulic cylinders. Continued influx of hydraulic fluid thus causes the larger cylinder to pull the next adjacent, smaller cylinder upwardly therewith. In this fashion, a plurality of nesting cylinders are raised to an extended position. As the hydraulic cylinders move upwardly, as mentioned above, the upper cylinder is secured to the upper tower section. The upper tower section thus moves from within its nesting position to an extended position.

Coupling means are likewise provided on the tower sections that join the tower sections together for extension. At a particular predetermied time thereafter, the upper tower section engages the coupling means between the upper and next adjacent tower section whereby the next adjacent tower section is withdrawn from a nesting position and accompanies the top section to an extended position. Each subsequent section is likewise raised until the tower is fully extended. Once the tower is extended, hydraulic fluid is maintained in the cylinders and collapse of the tower is precluded even in the event of loss of power. To lower the tower, a control valve is opened to bleed hydraulic fluid back to the fluid reservoir. As hydraulic fluid leaves the cylinder, the weight of the sections causes gravitational collapse of the tower. The rate of egress of the hydraulic fluid from the cylinders determines the rate of collapse of the tower. Close control of collapse can then be instituted.

In a preferred embodiment of the present tower, a collar is provided around the lower part of the raiseable hydraulic cylinders and threadedly secured thereto. The collar then engages a shoulder of a piston at an upper end of the next adjacent hydraulic cylinder. As such, there is a direct transfer of force to the next adjacent cylinder so as to assist in pulling same upwardly due to the continued hydraulic pressure being applied thereto. Also, upward movement of each section is limited.

Insofar as the coupling mechanism for the tower sections is concerned, a preferred arrangement finds a spring loaded plunger type member provided on each section adjacent an upper, non-nesting portion thereof. One arrangement finds a spring loaded plunger on opposite sides of the tower section with the plungers for the next adjacent section being each 90° apart from the first set of plungers. Slots are provided on adjacent tower sections to receive the plungers when mated therewith, thus coupling the sections to continue upward movement on a unit. The coupling plungers are most preferably beveled along an upper surface thereof so as to automatically disengage from the slot upon collapse of the tower when the weight of the tower section overcomes the force of the plunger spring and forces the plunger back into a spring loaded position away from the slot.

The tower of the present invention is most preferably supported on a mobile vehicular base such as a trailer or the like. The mobile base may be self propelled, however, and may or may not have its own generator so as to afford an independent source of power therefor. Preferably, lights are provided atop the tower for lighting carnival midways, sports events, construction sites and the like. Likewise, numerous other devices may be received atop the instant tower.

DESCRIPTION OF THE PREFERRED EMBODIMENTS

Figure 1:
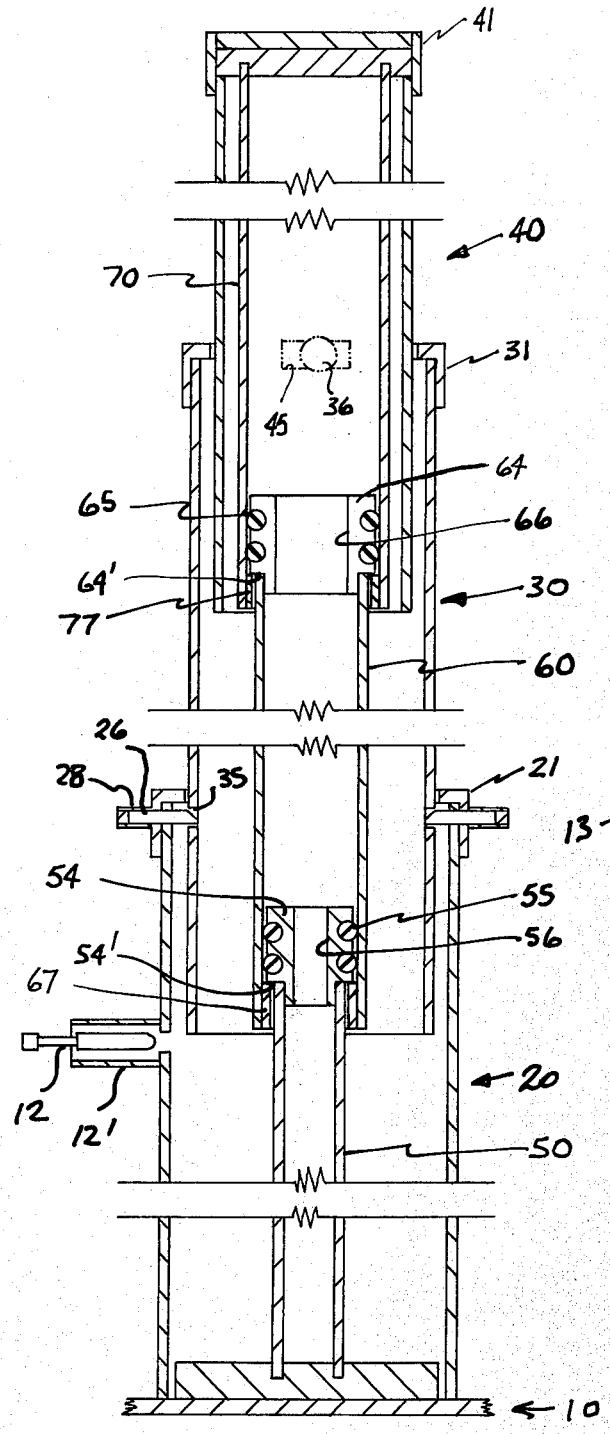
FIG. 1 is a vertical cross sectional view of an extendible tower according to the teachings of the present invention.

Referring to the Figures, specific embodiments of the present invention will now be described in detail. In FIG. 1, a tower is illustrated in an extended position showing a base generally indicated as 10 having a first tower section generally indicated as 20 rigidly secured thereto. A second tower section generally indicated as 30 and a third section generally indicated as 40 are shown extended from a nesting position within section 20. Tower sections 20, 30 and 40 are provided with section covers 21, 31 and 41 respectively, which provide proper tolerance at the section junctions and in the case of section 40, seal the upper end thereof. The tower shown in FIGS. 1 and 2 does not utilize external guide means during the raising and lowering thereof, but instead, relies upon dimensional tolerance between the sections to permit a smooth ascent and descent of the tower.

Figure 2:
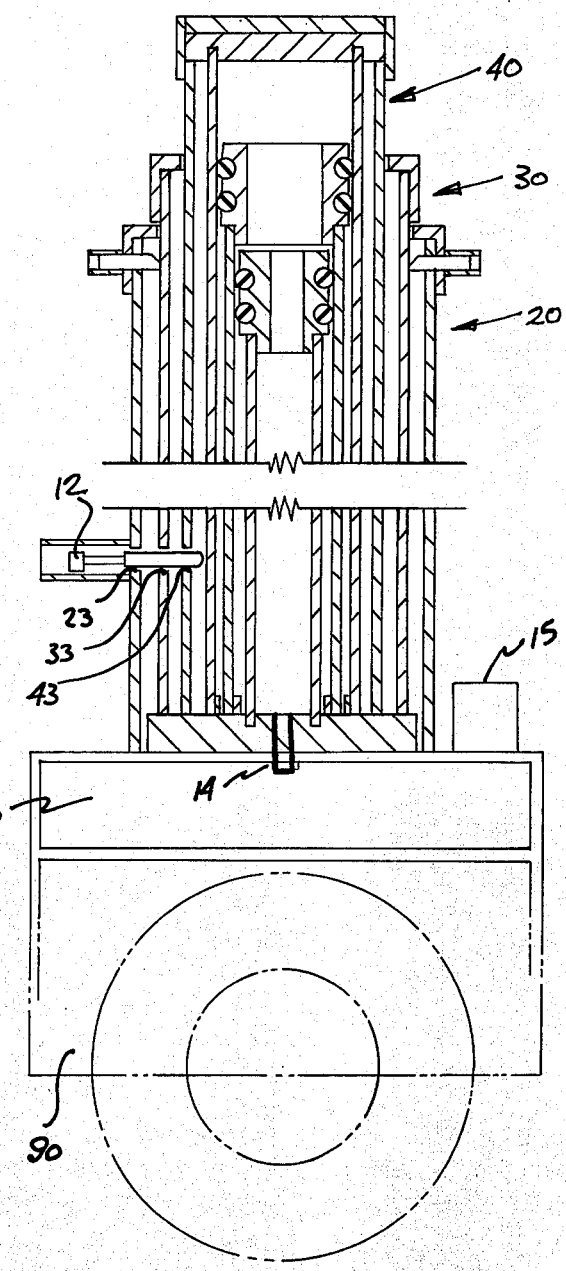
FIG. 2 is a side cross sectional view of the tower as shown in FIG. 1 with the tower being in a collapsed position.

In FIG. 2, all of the sections are collapsed with sections 30 amd 40 residing within section 20 and with the lower ends 32 and 42 residing atop a portion of base 10. With the tower in the collapsed position, it may be desirable to lock the sections together. Primarily, the joining of the sections avoids rattling during transit and joggling of the individual sections or components which could cause failure of the tower at a later date. A locking pin 12 is received in a housing 12' along bottom tower section 20 and comes into alignment with mating slots 33 and 43 of sections 30 and 40 when the tower is completely collapsed. Locking pin 12 may thus pass through slots 33 and 43 and join all of the tower sections together. Pin 12 is extracted before raising the tower and resides in its housing 12' during extension of the tower.

The tower of the present invention is operated hydraulically. A nested group of hydraulic cylinders 50, 60 and 70 are received within tower sections 20, 30 and 40 and are in communication with each other through ports 56 and 66 respectively, and with a hydraulic reservoir 13 through a suitable valved passageway 14. A hydraulic pump 15 with a suitable motor or other power source (not shown) is provided to pump hydraulic fluid from within reservoir 13 into cylinders 50, 60 and 70. As can be seen in the Figures, hydraulic cylinders 50, 60 and 70 are inverted with cylinder 70, the largest being on top and being secured by suitable means to the inside of tower section 40, preferably at the top end thereof. Smaller hydraulic cylinders 60 and 70 thus reside within the underside of cylinder 70 when in the collapsed position. Bottom hydraulic cylinder 50 is secured to base 10 and has a passageway 14 that communicates with hydraulic reservoir 13.

Cylinder 50 has a piston 54 received at an upper end thereof which has O-rings or the like 55 therearound and coact with the inner surface of cylinder 60 to afford a hydraulic seal thereat. Likewise, cylinder 60 has a piston 64 with O-rings or the like 65 therearound to provide a hydraulic seal along the inner wall of cylinder 70. Ports 56 and 66 permit passage of hydraulic fluid among the three cylinders.

Figure 3:
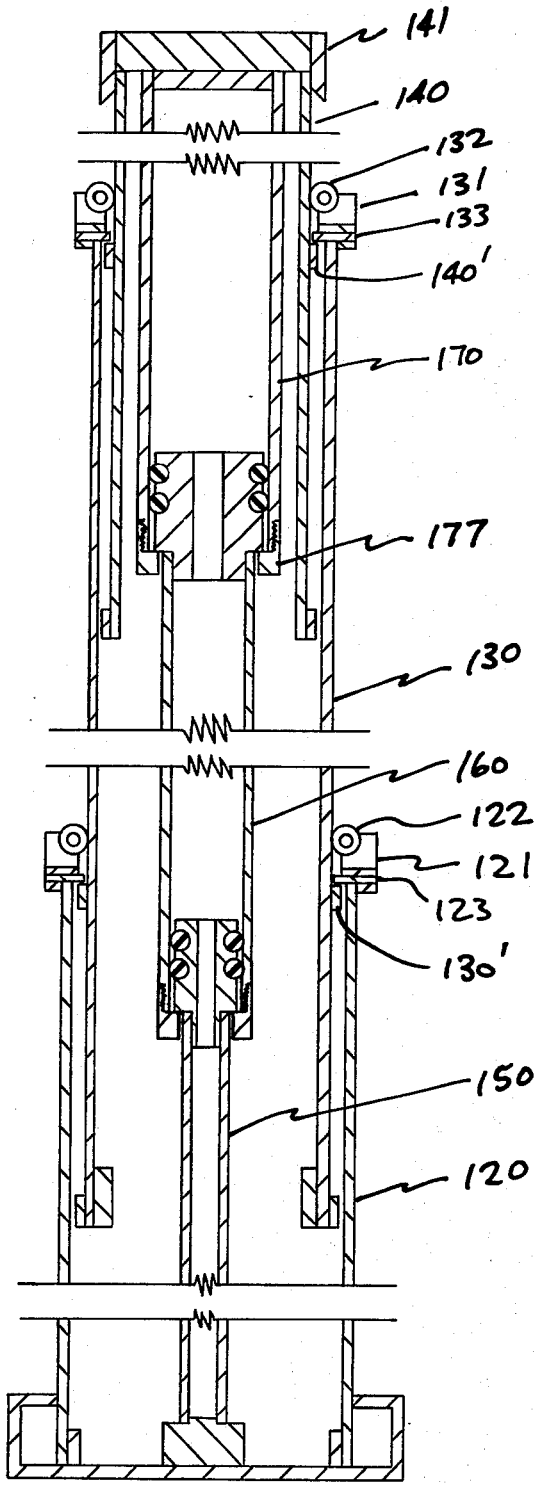
FIG. 3 is a vertical cross sectional view of a tower, illustrating a further embodiment of the present invention.

Hydraulic fluid is pumped from reservoir 13 into the interior of cylinder 50, passing through ports 56 and 66 into cylinder 70 and forces cylinder 70 upwardly. Since cylinder 70 is secured to tower section 40, section 40 likewise moves upwardly. Cylinder 70 has a sleeve bushing 77 received around the lower end thereof as shown in FIG. 1. Bushing 77 is shown in FIG. 3 as a collar 177. During upward movement of cylinder 70, bushing 77 contacts a lower side 64' of piston 64 and assists in lifting cylinder 60 while also limiting the relative upward movement of cylinder 70. Cylinder 60 has a similar bushing 67 as does each successive raiseable cylinder, each of which engages the underside of the piston adjacent thereto. With the hydraulic cylinders in the extended position all power may be lost and the tower will remain in the raised position so long as the hydraulic fluid remains.

As the inverted hydraulic cylinders move upwardly, tower sections 40 and 30 likewise move upwardly. Tower section 40 moves with cylinder 70 to a point where slots 45 in tower section 40 match with a plunger 36 that is held under tension by a spring 37 within a housing 38 provided therefor. Plunger 36 thus moves within slots 45 and couple tower sections 40 and 30 whereby section 30 is then pulled to the extended position. As tower section 30 moves upwardly, slots 35 provided thereon likewise match with plunger 26 of tower section 20 to couple sections 30 and 20. As shown in FIG. 1, two plungers are provided on opposite sides of the section. Also as shown, plunger 26 is 90° apart from plunger 36 to better balance the section coupling. The top of the plungers as may be seen on plunger 26 is provided with a beveled surface 26' which is engaged by the cylinder wall defining the mating slot to bias the plunger back into a spring loaded position within housing 28.

FIG. 2 shows a tower received on a trailer 90 that provides a suitable means for transporting same. If desirable, a generator may also be provided on the trailer to provide a self contained power unit.

FIG. 3 illustrates a further embodiment of the tower of the present invention. Tower sections 120, 130 and 140 are provided and are lifted by hydraulic cylinders 150, 160 and 170. Tower sections 130 and 120 are provided with collars 121 and 131 respectively. Collars 131 and 121 are provided with rollers 132 and 122 which contact the outer surface of the next adjacent tower section and guide same during ascent and descent of the tower. Collars 131 and 121 are provided with members 133 and 123 respectively that protrudes inwardly and defines a shoulder. A protrusion 140' on section 140 and 130' on section 130 then engages shoulders 133 and 123 respectively during ascent of the tower to couple the tower sections.

The tower may be collapsed by opening valve 14' to permit return of hydraulic fluid to reservoir 13. Once the hydraulic pressure is released, the individual tower sections and hydraulic cylinders begin to collapse under their own weight returning to the nested position.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. An extendible tower structure comprising:

a. a base;

b. a hydraulic fluid reservoir secured to said base;

c. a plurality of nestable tower sections received on said base, a largest of said sections being secured to said base, each adjacent section having means received thereon to engage and raise the next adjacent smallest section;

d. a plurality of nestable hydraulic cylinders received within said tower sections, a largest of said cylinders being permanently secured to the smallest tower section and the smallest of said cylinders being permanently secured to said base and in communication with said hydraulic fluid reservoir, said smallest cylinder and each intermediate cylinder having a piston located thereon, said pistons having sealing rings therearound and producing a seal along the inside wall of the next adjacent larger cylinder, each piston having a fluid port therein, and each cylinder engaging the next adjacent smallest cylinder and raising same during raising of the tower; and e. means to controllably supply hydraulic fluid under pressure into said smallest cylinder, said fluid passing through said cylinders to said largest cylinder, and raising said cylinder one at a time, whereby said tower is raised thereby.

2. An extendible tower as defined in Claim 1 wherein each raiseable cylinder is provided with a member adjacent an end thereof, and a piston at an opposite end thereof, said member on one cylinder engaging said piston on a next adjacent cylinder during raising of said tower whereby each cylinder pulls the next adjacent cylinder.

3. An extendible tower as described in Claim 1 wherein said raiseable tower sections are provided with slots therein and spring loaded members, the spring loaded members of one section engaging the slots of the next adjacent section to couple said sections and cause the secured section to be raised.

4. An extendible tower as defined in Claim 3 wherein said spring loaded members are beveled along an upper surface thereof whereby said members are forced out of said slots during lowering of the section of the tower containing said slots.

5. An extendible tower as defined in Claim 4 wherein each raiseable section has slots at one end thereof and spring loaded members at an opposite end thereof, said spring loaded members being located on different sides of said section than said slots.

6. An extendible tower as defined in Claim 1 wherein the base and each intermediate tower section is provided with guide means adjacent an upper end thereof.

7. An extendible tower as defined in Claim 1 wherein said tower is secured to a vehicle body.

* * * * *